United States Patent [19]

Daniels

[11] Patent Number: 4,887,319

[45] Date of Patent: Dec. 19, 1989

[54] UNITARY CONTIGUOUS FACE AND NECK PROTECTOR ALL WEATHER COVER FOR HARD HEAD GEAR

[76] Inventor: Darleen Daniels, P.O. Box 1221, Port Neches, Tex. 77651

[21] Appl. No.: 248,947

[22] Filed: Sep. 21, 1988

[51] Int. Cl.[4] ..... A42B 3/00

[52] U.S. Cl. ..... 2/410; 2/425; 2/5

[58] Field of Search ..... 2/5, 205, 410, 424, 2/425

[56] References Cited

U.S. PATENT DOCUMENTS

| | | | |
|---|---|---|---|
| 1,639,468 | 8/1927 | Rosenberg et al. | 2/205 X |
| 2,567,192 | 9/1951 | Grazia | 2/205 |
| 3,055,012 | 9/1962 | Aileo | 2/205 X |
| 3,100,896 | 8/1963 | Khangegian | 2/5 |
| 3,146,462 | 9/1964 | Militello | 2/3 |
| 3,205,508 | 9/1965 | Cox | 2/410 |
| 3,594,814 | 7/1971 | Schuessler | 2/3 |
| 4,091,469 | 5/1978 | Davidson | 2/410 |
| 4,272,536 | 6/1981 | Schuessler | 2/424 |

FOREIGN PATENT DOCUMENTS

| | | | |
|---|---|---|---|
| 2708558 | 8/1978 | Fed. Rep. of Germany | 2/174 |
| 3110593 | 7/1982 | Fed. Rep. of Germany | 2/410 |
| 3314595 | 3/1983 | Fed. Rep. of Germany | 2/410 |
| 850330 | 12/1939 | France | 2/174 |

*Primary Examiner*—Werner H. Schroeder
*Assistant Examiner*—Jeanette E. Chapman
*Attorney, Agent, or Firm*—A. Robert Theibault

[57] ABSTRACT

The present disclosure is directed to a weather protective unitary contiguous substantially flat face and neck cover for use with hard head gear. The cover has an outer layer of non-stretchable waterproof highly reflective nylon having a liner of thermally insulated material. The cover has a top bridge portion above the face of the wearer which terminates in side flaps. Waterproof elastic piping is secured about the free edge of the cover to seat tightly about the portions of the hard hat with which it is in contact as well as to seat tightly about the face and neck of the wearer to shut out weather elements such as wind, snow, rain and the like from contact with the wearer over the area covered by the unitary face and neck cover. The side flaps extending off the top bridge portion have flap securing means to maintain the flaps connected at their free ends beneath the chin of the wearer.

1 Claim, 2 Drawing Sheets

UNITARY CONTIGUOUS FACE AND NECK PROTECTOR ALL WEATHER COVER FOR HARD HEAD GEAR

TECHNICAL FIELD

The present disclosure is directed to the field of weatherproof covers to protect wearers of hard head gear from elements of weather such as wind, snow, rain and the like including excessive sun.

BACKGROUND OF THE INVENTION

The wearers of "hard hats" required in industrial operations, construction areas of hazzardous manufacturing areas must work not only in closed areas but also in outside areas where they are subjected to the elements of wind, sun, snow and rain where they are provided with little or no protection of their head and neck area against cold under extreme conditions.

Numerous devices have been advanced to be placed over the crown of hard hats such as shown in the following U.S. Patents:

U.S. Pat. No. 3,100,896
U.S. Pat. No. 3,146,462
U.S. Pat. No. 3,205,508
U.S. Pat. No. 3,594,814
U.S. Pat. No. 4,091,469
U.S. Pat. No. 4,272,853

The above patents are provided with covers of multiple panels requiring sewing of knit porous stitching which stretches and permits drafts around the face, head and neck areas.

SUMMARY OF THE INVENTION

An important aspect of the present invention is the provision of a single unitary contiguous face and neck protector all weather cover for hard head gear having only one seam and being urged into sealing contact with the hard hat, face and neck of the wearer by resilient elastic piping which acts as a seal between the hard hat and areas of the person wearing the hard hat and covering which has ear flaps which pass beneath the chin of the wearer and which because the cover is of waterproof nylon, thermally insulated non-stretchable material forms a weather seal between the hard hat and its wearer. The use of Velcro fasteners between the ear flaps makes the cover adjustable and permits of a tight fit of the flaps about the face and under chin neck area to exclude the elements.

The use of a highly reflective substance on the exterior of the cover acts as a safety factor to reflect the presence of the hat wearer to vehicles to avoid striking the wearer. The unitary cover with its elastic weatherproof piping acts as a weather seal between the wearer of the hard hat, the hard hat and the face and neck area of the wearer.

DESCRIPTION OF THE PREFERRED EMBODIMENT OF THE INVENTION

Figure 2:
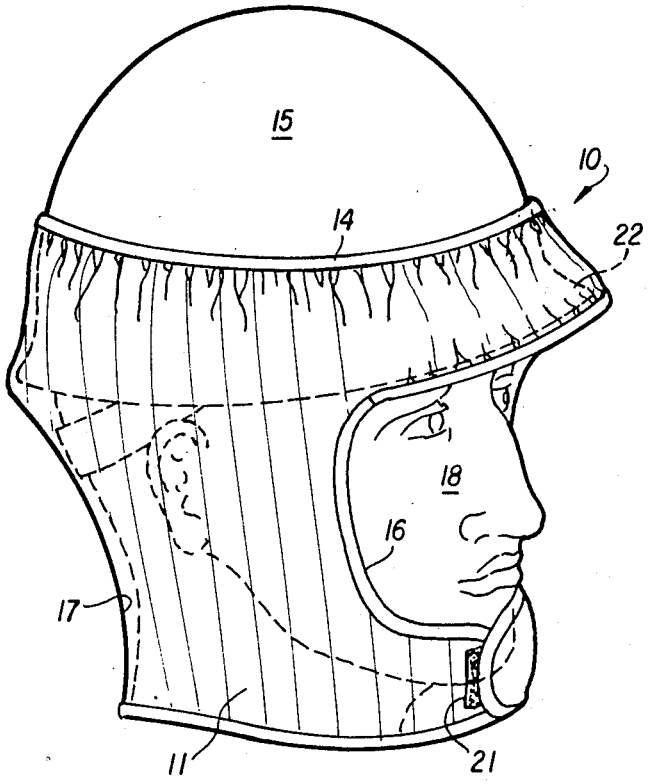
FIG. 2, is a perspective view of a hard hat having the cover of FIG. 1 placed thereover upon the head of a wearer.

Referring now to the drawings and for the moment to FIGS. 1 through 4, the hard hat cover 10 of the present invention is made from a single piece of contiguous waterproof non-stretchable nylon 11, having a backing liner of thermally insulated material 12 secured to its interior by lines of stitching 13. The border of the cover 10 has stitched about its outer boundaries a water proof elastic piping 14, causing the cover 10 to resiliently grip the crown of the hard hat 15 and the face and neck of the wearer at 16, 17 to provide a substantially draft proof weather seal between the cover 10 and the face 18 of the wearer.

Figure 3:
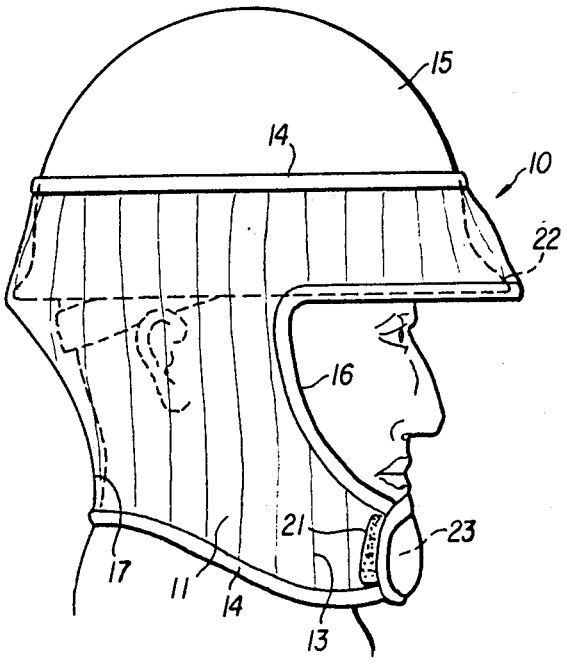
FIG. 3, is a side elevational view of the hard hat and cover of FIG. 2.
Figure 4:
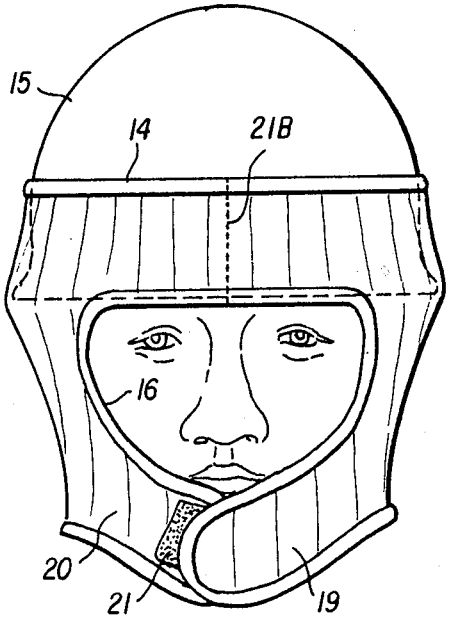
FIG. 4, is a front elevational view of the hard hat and cover of FIGS. 2 and 3.

The side portions of the cover 10 provide ear flaps 19, 20 best seen in FIGS. 1 through 4. These ear flaps 19, 20 are integrally joined by top bridge portion 21 and 21A which passes over the brim 22 of the hard hat 15 and are joined by stitching 21B, The free ends of the ear flaps 19, 20 are provided with complemental VELCRO fasteners 21, 22 for securing the ends firmly beneath the chin of the wearer as shown in FIGS. 3 and 4 to provide a weather tight seal to shut out wind, rain, snow and other adverse weather conditions from the head and neck area of the wearer. Snap fasteners may be employed in lieu of VELCRO fasteners.

Figure 5:
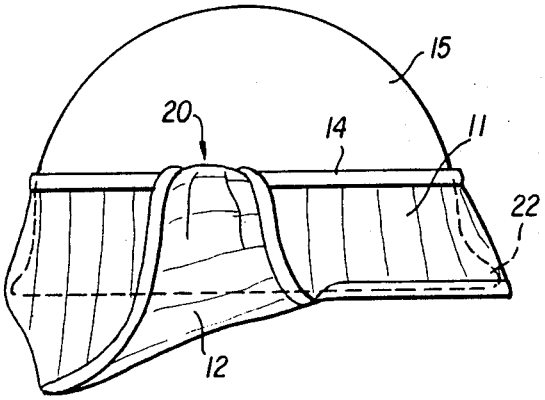
FIG. 5, is a view similar to FIG. 3 with the right ear flap tucked up between the piping of the cover and crown of the hat to promote ventilation to the head of the wearer during hot weather.
Figure 6:
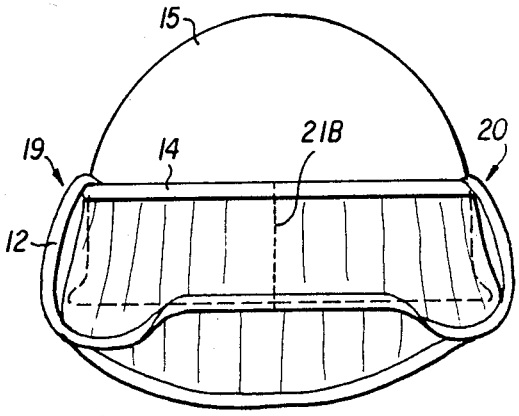
FIG. 6, is a front elevational view of the hard hat and cover of FIG. 5 with both ear flaps raised and tucked in between the crown of the hard hat and the elastic piping of the cover.

As shown in FIGS. 5 and 6 the ear flaps 19, 20 are raised and tucked in between the piping 14 and the crown of the hard hat 15 to permit ventillation to the head of the wearer during summer or hot environment area operations.

Figure 1:
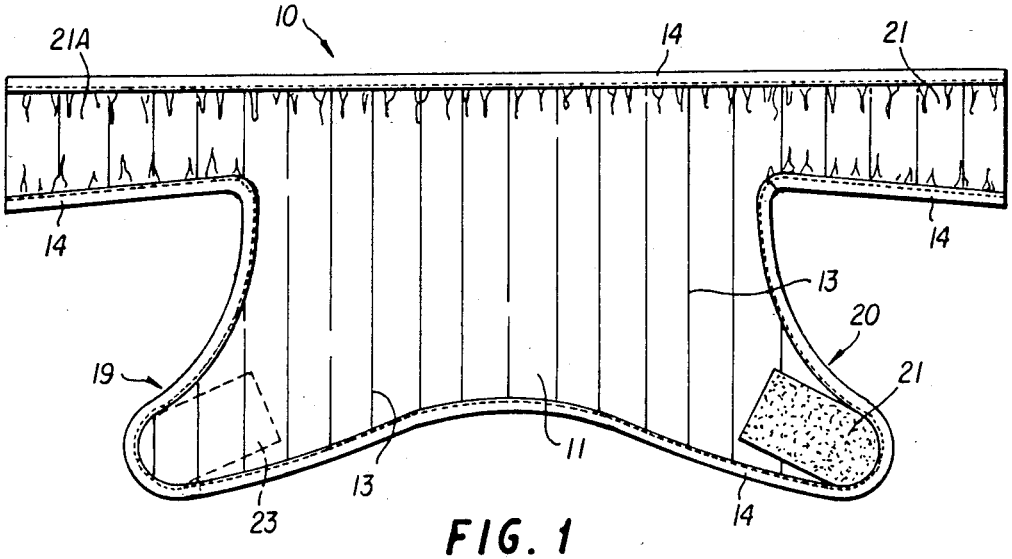
FIG. 1, is a plan view of the one-piece pattern of the hard hat cover of the present invention, showing the construction of the non-stretchable waterproof external nylon external backing having a liner of thermally insulative material.

The two free ends of the top bridge portion 21, 21A at the top of FIG. 1 are joined by stitching 21B causing the top bridge portion to seat over the brim 22 of the hard hat 15.

What I claim is:

1. For use with hard head gear having a brim a weather protective unitary contiguous one piece outer covering comprising an inelastic deformable singular unitary face and neck portion of non-stretchable thermally lined water proof nylon having a colored outer surface, said cover having a top bridge portion adapted to overlie the brim of the hard head gear above the face of the wearer and terminating in side flaps adapted to be fastened beneath the chin of the wearer, waterproof elastic piping secured about the free edge of said cover adapted to cause the cover to seat tightly about the hard hat exterior with which it is in contact as well as to seat tightly about the face and neck of the wearer to shut out weather elements and the like from contact with the hard head gear wearer over the area covered by said unitary face and neck cover and means on said side flaps for securing the terminal ends of said flaps beneath the chin of the wearer.

* * * * *